US005884592A

United States Patent [19]

Korostenski et al.

[11] Patent Number: 5,884,592

[45] **Date of Patent: *Mar. 23, 1999**

[54] VALVE GEAR MECHANISM FOR AN INTERNAL COMBUSTION ENGINE

[76] Inventors: Erwin Korostenski; Reiner Walter, both of Heilbronner Strasse 6, D-74172 Neckarsulm; Armin Bertsch, Mutbrunnengasse 9, D-74196 Neuenstadt, all of Germany

[ * ] Notice: This patent issued on a continued prosecution application filed under 37 CFR 1.53(d), and is subject to the twenty year patent term provisions of 35 U.S.C. 154(a)(2).

[21] Appl. No.: 849,846

[22] PCT Filed: Dec. 12, 1995

[86] PCT No.: PCT/DE95/01783

§ 371 Date: Aug. 22, 1997

§ 102(e) Date: Aug. 22, 1997

[87] PCT Pub. No.: WO96/18807

PCT Pub. Date: Jun. 20, 1996

[30] Foreign Application Priority Data

Dec. 13, 1994 [DE] Germany ..... 44 44 289.0
Aug. 9, 1995 [DE] Germany ..... 195 29 346.0

[51] Int. Cl.[6] ..... F01L 1/356; F01L 1/344

[52] U.S. Cl. ..... 123/90.17; 123/90.31; 74/568 R

[58] Field of Search ..... 123/90.15, 90.17, 123/90.31, 90.6; 74/567, 568 R

[56] References Cited

U.S. PATENT DOCUMENTS 5,333,579 8/1994 Hara et al. ..... 123/90.17
5,494,009 2/1996 Yamada et al. ..... 123/90.17

FOREIGN PATENT DOCUMENTS 2 305 589 10/1976 France .
WO88/08919 11/1988 WIPO .

OTHER PUBLICATIONS

Patent Abstracts of Japan, vol. 17, No. 486 (M–1473), 3 Sep. 1993 & JP,A,05 118208 (Shigeru Kawakami), 14 May 1993.

*Primary Examiner*—Weilun Lo
*Attorney, Agent, or Firm*—Edward M. Livingston, Esq.

[57] ABSTRACT

A valve gear mechanism for an internal combustion engine includes a variable valve control mechanism comprising a shaft (1) having an axis of rotation (D) and serving to transmit the rotary motion to the valve gear mechanism; a rotating body (10) being rotatably supported on said shaft (1); and an intermediate member (20) surrounding said shaft (1) and being disposed adjacent to said rotatable rotating body (10) in an axial direction and being rotatable with respect to said shaft (1) and having a drive connection to said shaft (1) via a first sliding guide (15) and a first transmission element (40, 50) and to said rotating body (10) via a second sliding guide (16) and a second transmission element (70), wherein said first transmission element (40, 50) comprises a radial pin (40) being inserted in said shaft (1) in a direction substantially vertical to said axis of rotation (D). The radial pin (40) is preferably held so as to be displaceable in a recess (51) of a sliding block (50) which is pivotably mounted in a bearing seat (22) in said intermediate member (20).

18 Claims, 9 Drawing Sheets

VALVE GEAR MECHANISM FOR AN INTERNAL COMBUSTION ENGINE

The invention relates to a valve gear mechanism for an internal combustion engine and particularly to a valve gear mechanism for an internal combustion engine, wherein a rotating body, preferably a cam, is rotatable in a cyclical manner on a shaft, preferably a cam shaft, during rotation of such shaft in order to provide thereby a variable valve control.

A valve gear mechanism of such kind is for instance disclosed in the German patent application 195 02 836.8 which does not constitute a prior disclosure. A timing mechanism disclosed in this patent application is shown in FIG. 23 and includes a cam shaft 100 having an axis of rotation 500 on which a cam 200 is supported. Also supported on the cam shaft 100 is an inner eccentric element 300, that inner eccentric element 300 having an outer surface 320 being eccentric element with respect to axis of rotation 500 on which an outer eccentric element 400 is supported. The outer eccentric element 300 and the inner eccentric element 400 are rotatable via an inner eccentric gear ring 340 and an outer eccentric gear ring 440, respectively, whereby an intermediate member 490 supported on an eccentric outer surface of the outer eccentric element 400 is displaceable with respect to the cam shaft 100 in a plane perpendicular to that axis of rotation 500. The intermediate member 490 is operationally linked with the cam 200 and the cam shaft 100. In order to accomplish this, an axial pin 800 rotatably supported in the cam shaft 100 as a first transmission element 800 is in engagement with a first groove 600 formed as a sliding guide in the intermediate member 490, the engagement being effected by a sliding block lug 810 integrally formed with that axial pin 800. A second groove 700 of intermediate member 490 located diametrically opposed first groove 600 is in engagement with a sliding block lug 910 integrally formed with a second axial pin 900 being rotatably supported in a bore 110 of cam 200.

The rotation of cam shaft 100 is transmitted via first axial pin 800 by lug 810 thereof and first groove 600 to intermediate member 490 and further via second groove 700 and lug 910 of second axial pin 900 to cam 200. If the intermediate member 490 is in a concentric position with respect to cam shaft 100, cam 200 rotates in synchronism with cam shaft 100. Is, however, intermediate member 490 displaced in a plane perpendicular to the axis of rotation 500, during each rotation of cam shaft 100 there is a cyclic increasing and subsequent decreasing of the speed of rotation of cam 200 with respect to cam shaft 100 which is used to affect the effective duration of opening of a gas inlet valve of an internal combustion engine not shown which is actuated by a tappet 205.

With the motion just described there are exerted not only rotational forces but also a tilting moment onto intermediate member 490 which tilting moment acts on the bearing of intermediate member 490 on outer eccentric element 400. Due to this, comparatively high forces act in this region which forces are particularly critical in this region since it constitutes a fast running bearing which is exposed to the difference in speed of rotation between the outer eccentric element 400 almost standing still and the intermediate member 490 rotating with almost the same speed of rotation as the cam shaft. Under unfavorable circumstances, the intermediate member 490 may tend to tilt and jam.

A further disadvantage of this known device is provided by the fact that such tilting moment of intermediate member 490 has the effect that parallelism to cam 200 cannot be ensured. This may have the effect that there is not always planar contact between sliding block lugs 810 and 910 of axial pins 800 and 900, respectively, and grooves 900 and 700, respectively, of intermediate member 490 but that there is only contact at the respective edges. This substantially increases the wear in this region.

SUMMARY OF THE INVENTION

It is an object of the present invention to further develop the prior art described above such that in a compact device occupying minimal space the friction between components moving with respect to each other and, accordingly, the wear of such components is reduced.

According to the present invention a valve gear mechanism for an internal combustion engine comprises a timing mechanism disposed on a shaft having an axis of rotation and serving to transmit the necessary rotary motion to the valve gear mechanism, a rotating body mounted in such a way that it can turn about the shaft and an intermediate member which surrounds the shaft and is supported such that it can rotate with respect to the shaft and which is disposed aside of the rotatable rotating body in an axial direction and is rotatable with respect to the shaft, that intermediate member having a drive connection to the shaft via a first sliding guide and a first transmission element and to the rotating body via a second sliding guide and a second transmission element. At least one of the transmission elements comprises a radial pin which is disposed in a substantially perpendicular direction to the axis of rotation of the shaft.

The use of a radial pin as transmission element has the advantage that the tilting moment can be reduced at the introduction of the force so that the occurring overall tilting moment is reduced. Preferably, the first transmission element is a radial pin.

In order to enable the intermediate member to cause a cyclical rotation of the rotating body with respect to the shaft, a relative displacement between the shaft and the intermediate member in the longitudinal direction of the radial pin and a pivotal movement of the radial pin with respect to the intermediate member must be possible. This can, for instance, be accomplished such that the radial pin at that end which is in engagement with the intermediate member has a kind of ball head which is supported in the intermediate member. This allows the necessary pivotal movement. In such case, the radial displacement has to be effected by the radial pin being displaced in his longitudinal direction with respect to the shaft.

In another preferred embodiment the radial pin is slidably received in a recess of a sliding block which is pivotably supported in a bearing of the intermediate member. In this embodiment the pivotal movement occurs between the sliding block and the bearing of the intermediate member while the longitudinal displacement occurs between the radial pin and the sliding block. Due to this, the radial pin can be fixed in the shaft in a rigid manner.

In this embodiment the radial pin may have a cylindrical portion and a portion having a substantially rectangular cross section, the cylindrical portion being inserted in a radial bore of the shaft and the portion having a substantially rectangular cross section being in sliding engagement with the recess of the sliding block. Between the cylindrical portion and the portion of the radial pin having a substantially rectangular cross section there may be provided a step which in connection with an element which can be slipped on the shaft constitutes a form-fit lock against creeping of the radial pin out of the radial bore.

The diameter of the cylindrical portion is preferably smaller than the larger of the two sides of the cross section of the portion having a substantially rectangular cross section.

The sliding block preferably has the outer contour of a cylinder segment being flattened at two sides, wherein the two curved side surfaces are outer segments of a cylinder which are connected by a front surface. The recess is preferably open to that side of the sliding block opposing the front surface. The sliding block has two sliding surfaces for sliding contact with two opposing surfaces of the rectangular portion of the radial pin and two shoulders for abutment to a third surface of the rectangular portion of the radial pin. Between the shoulders there may be formed a dimple for facilitating mounting of the radial pin. Specifically, in case the diameter of the cylindrical portion of the radial pin is smaller as at least the larger of both of the sides of the cross section of the substantially rectangular portion, the cylindrical portion of the radial pin can be inserted into the radial bore of the shaft through that recess.

Preferably, the bearing seat has a discontinuity and is open at the side of the intermediate member facing the rotating body and has two concave side walls having an radius of curvature corresponding to the side surfaces of the sliding block and an end surface for contacting the end surface of the radial pin. Thus, the sliding block can be laterally inserted into the bearing seat.

The fixing of the rotating body and the intermediate member on the shaft in the axial direction may be effected via the radial pin.

The second transmission element may comprise an axial pin supported parallel to the axis of rotation in a bore of the rotating body. In order to realize a particularly compact assembly, an intermediate disk may have a gap which provides clearance with respect to the axial pin, this intermediate disk having a flattened region opposing that gap which is in contact with the sliding block and prevents rotation of the intermediate disk.

The side surfaces of the sliding block lug may extend on one or both sides of the axial pin beyond the circumference of its cylindrical shaft so that the axial pin together with the sliding block lug has an L-form or T-form. This provides an enlarged contact surface of the sliding block lug and, therefore, a reduction of surface pressure onto the groove of the intermediate member and in case of a T-form a symmetrical application of force.

The bore of the rotating body supporting the axial pin may be closed on the side opposite to the intermediate member and the shaft may have a longitudinal bore and one or a plurality of shaft oil bores extending from the longitudinal bore to the outer surface of the shaft. In the rotating body a rotating body oil bore may be provided such that oil from the longitudinal bore of the shaft can reach the bore for supporting the axial pin between the latter and the closed end of such bore via the shaft oil bore and the rotating body oil bore so that the axial pin is forced into close contact against the end wall of the groove of the intermediate member by the oil pressure.

Thus, the sliding condition of the sliding block lug in the groove is improved.

In a further advantageous embodiment there is provided a third sliding guide between the rotating body and the intermediate member, such third sliding guide providing a support between the rotating body and the intermediate member and allowing at the same time a relative movement between the rotating body and the intermediate member in a direction perpendicular to the axis of rotation.

Such third sliding guide serves to take up the tilting moment created by the transmission of the rotation to the intermediate member. By means of the support provided thereby the bearing surface between the intermediate member and the outer eccentric element facing a large difference in speed of rotation is relieved with respect to its load. By contrast, the support against such tilting moment is effected between the rotating body and the intermediate member which have only a small difference regarding their relative speed of rotation. In the valve gear mechanism according to the present invention the free tilting moment is supported by the large bearing surface between the rotating body and the shaft where also only small relative speed of rotation occurs and which accordingly faces only a minor load. Hence, the overall friction losses of the system are substantially reduced. Moreover, the supporting momentum of the outer eccentric element is substantially reduced.

The third sliding guide may be formed such that there is a groove provided in the rotating body which engages a web formed at the intermediate member. In a particular advantageous embodiment the groove extends in the circumferential direction of the rotating body and has a gap through which the intermediate member with its web can be inserted in a radial direction.

Adjacent to the web an intermediate disk may be received in the groove to enlarge the contact surface for the intermediate member. This provides contact of the intermediate member also in that region where the groove has its gap.

Since in the embodiment just described the free tilting moment is supported at the bearing between the rotating body and the shaft, this bearing preferably is formed particularly broad. Therefore, in the region of the bearing the rotating body may be formed broader in the direction of the axis of rotation and may have dimensions in this region which are larger than at least an other partial region of the outer contour of the rotating body.

Preferably, the shaft is a cam shaft and the rotating body is a cam for operating an exhaust or intake valve. This provides an extremely compact device for variable valve timing. The intermediate member may be formed such that its outer contour does not extend beyond the outer contour of the cam in any operational position. This enables use of this embodiment in engines having tappets.

BRIEF DESCRIPTION OF THE DRAWINGS

Further features and advantages of the invention will be apparent from the following description of preferred embodiments in connection with the accompanied drawing in which.

DESCRIPTION OF THE PREFERRED EMBODIMENT

Figure 1:
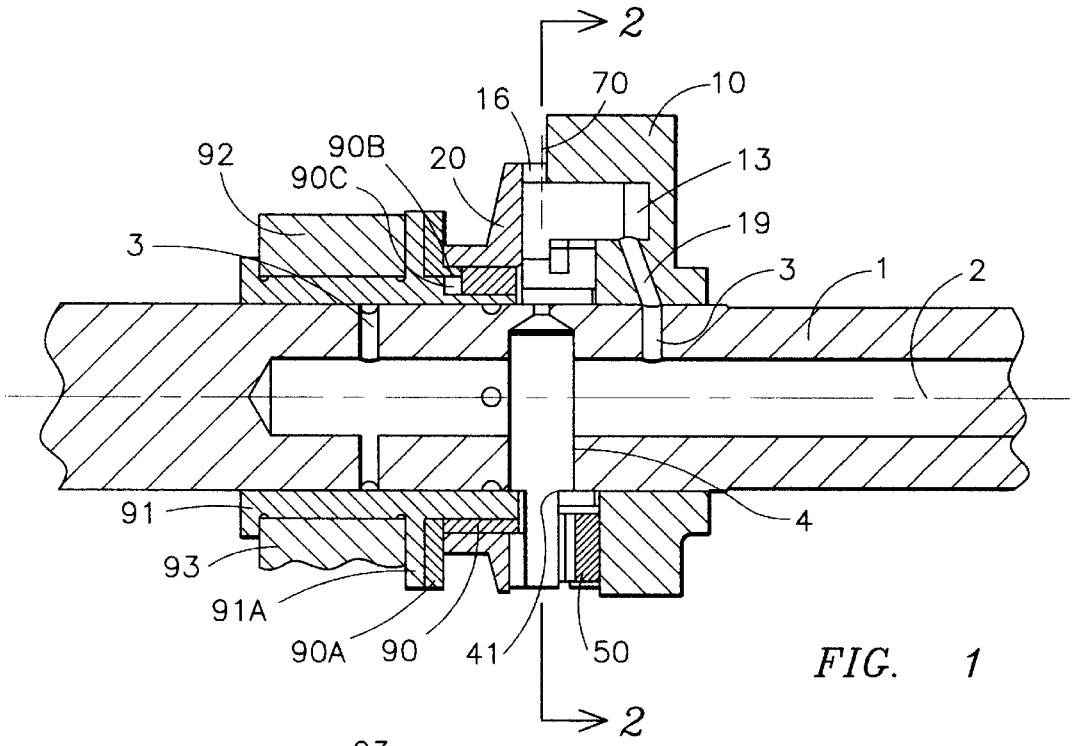
FIG. 1 is an axial section of a first embodiment of the assembly according to the present invention.
Figure 2:
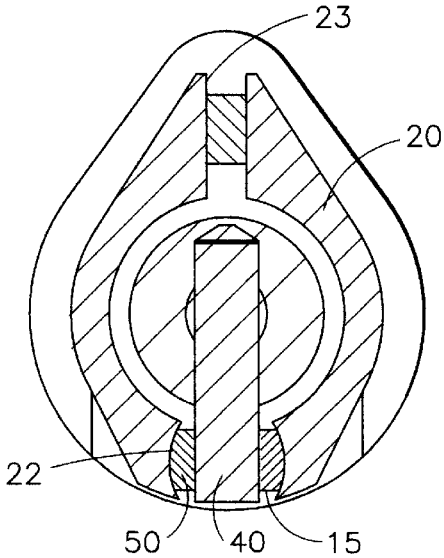
FIG. 2 is a radial section taken along line E—E in FIG. 1.
Figure 3:
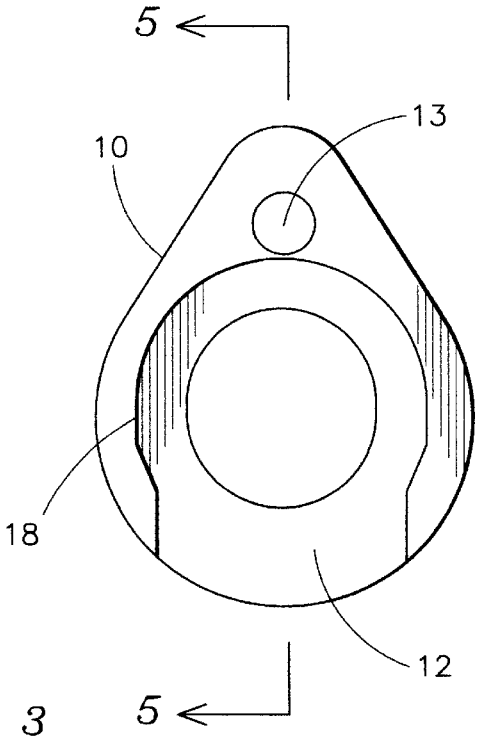
FIG. 3 is a front view of a rotating body formed as a cam.
Figure 1A:
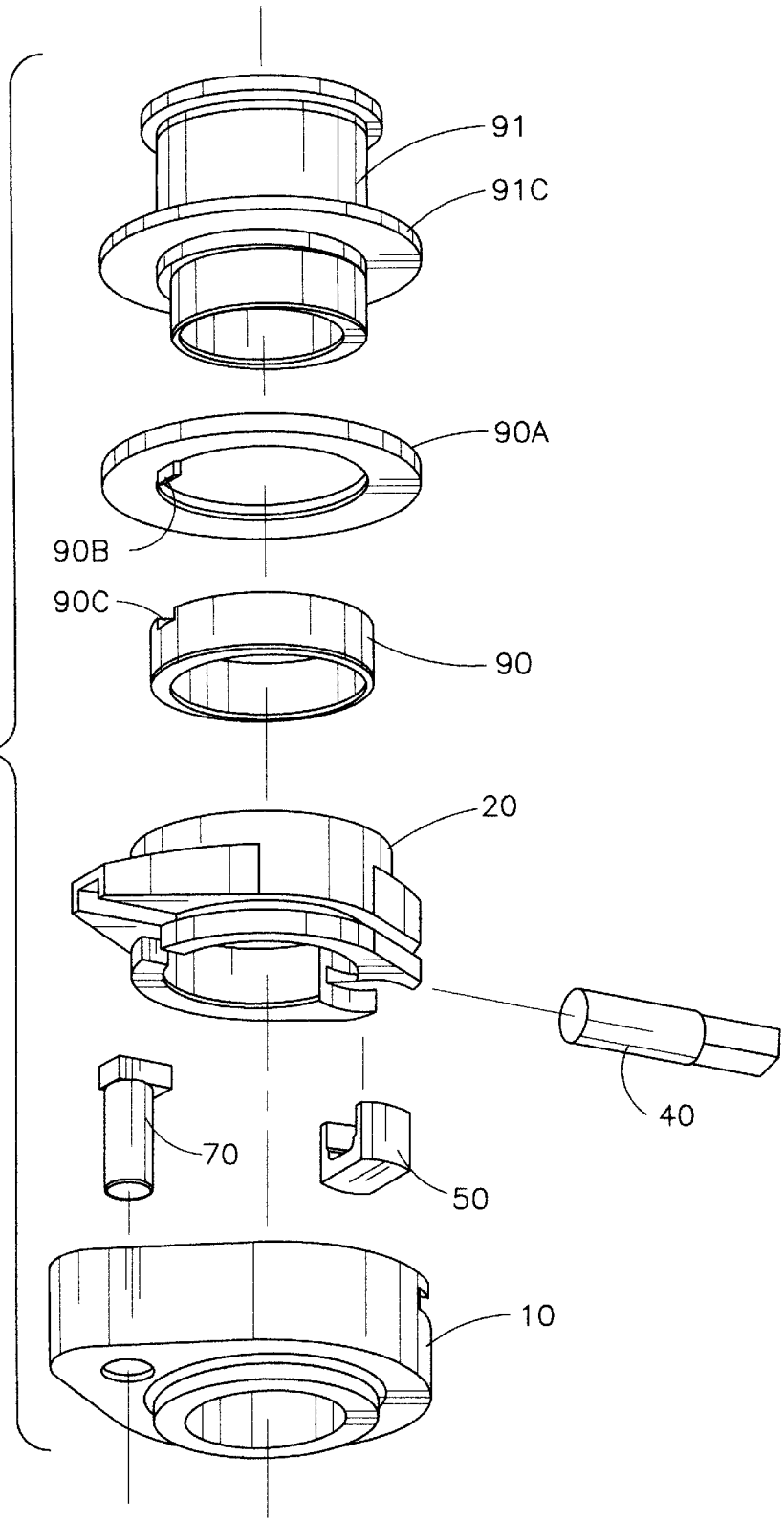
FIG. 1*a* is an exploded perspective view of substantial components of the assembly according to FIG. 1 where the cam shaft is omitted.
Figure 1B:
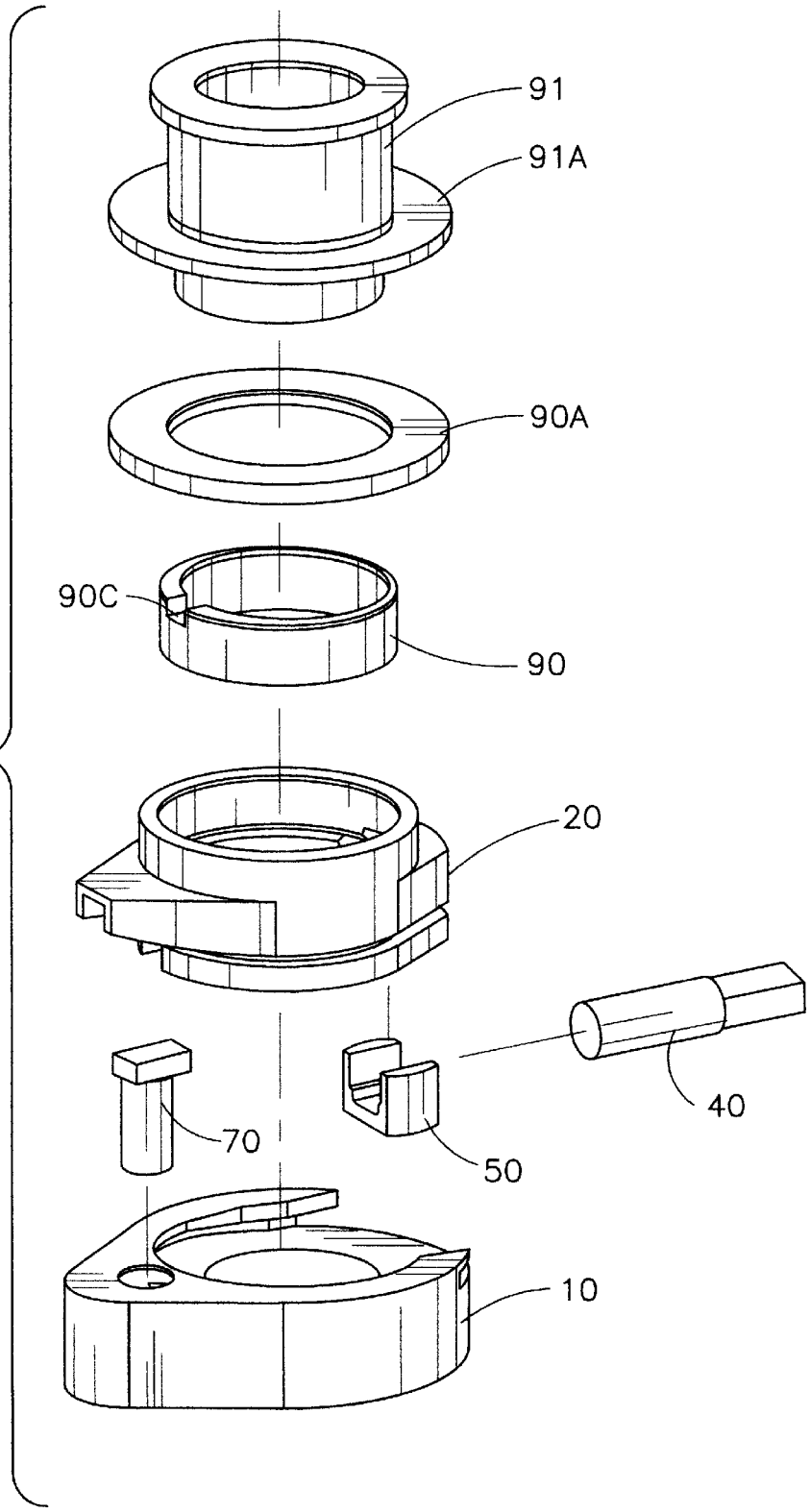
FIG. 1*b* is an exploded perspective view corresponding to FIG. 1*a* shown under a different angle of view.
Figure 4:
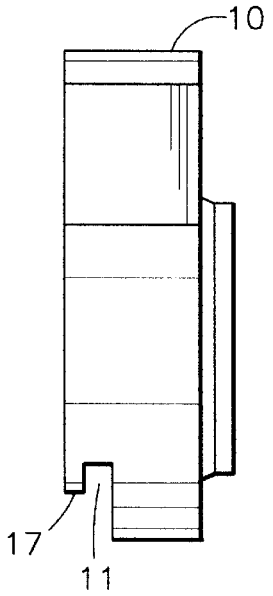
FIG. 4 is a side view of the cam shown in FIG. 3.
Figure 5:
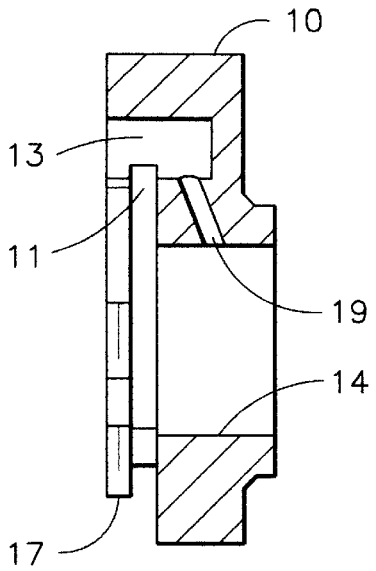
FIG. 5 is a sectional view of the cam taken along line C—C in FIG. 3.
Figure 6:
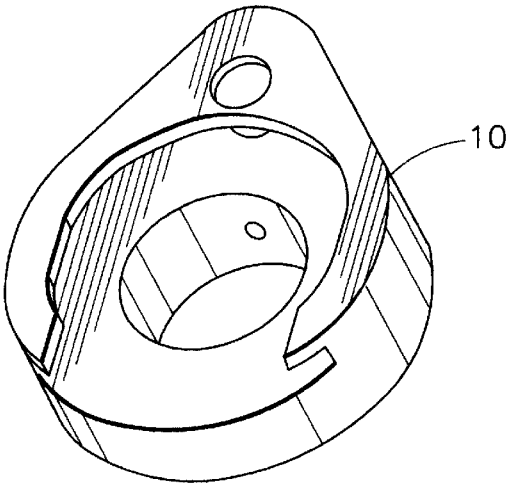
FIG. 6 is a perspective view of the cam according to FIG. 3.
Figure 7:
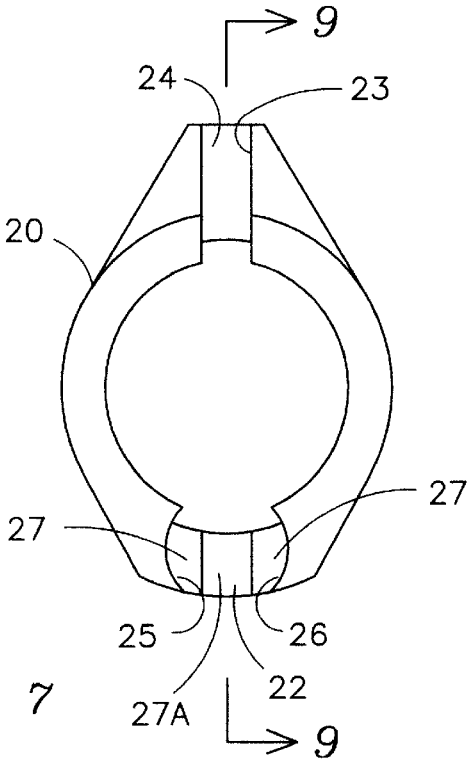
FIG. 7 is a front view of an embodiment of an intermediate member.
Figure 8:
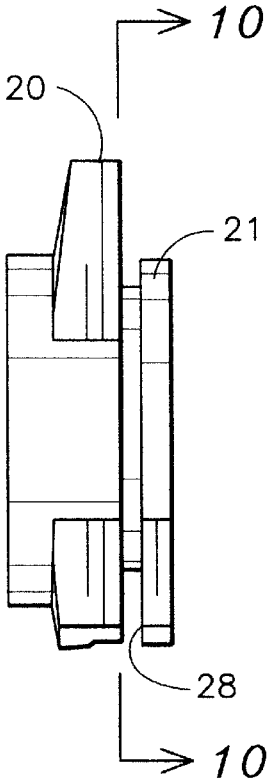
FIG. 8 is a side view of the intermediate member shown in FIG. 7.
Figure 9:
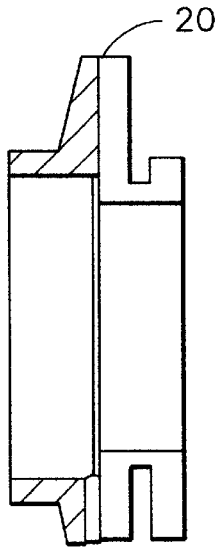
FIG. 9 is a sectional view of the intermediate member taken along line H—H in FIG. 7.
Figure 10:
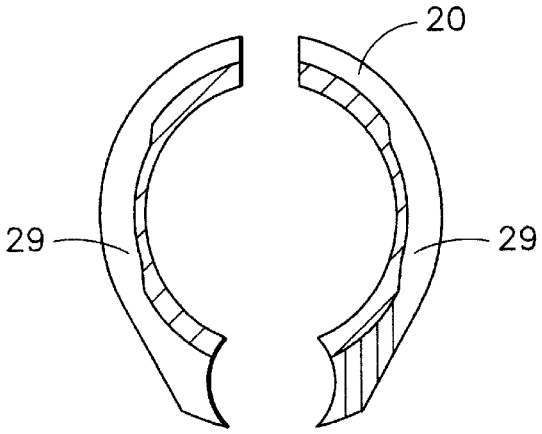
FIG. 10 is a sectional view of the intermediate member taken along line I—I in FIG. 8.
Figure 11:
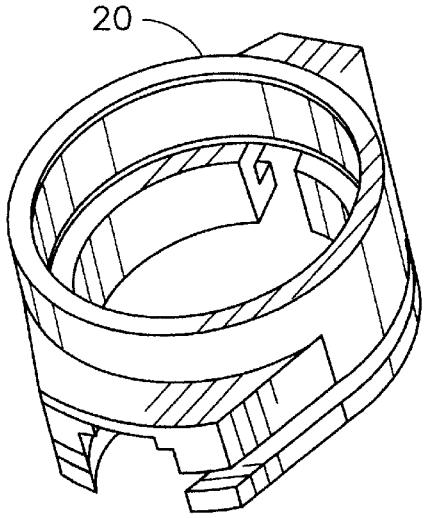
FIG. 11 is a perspective view of the intermediate member shown in FIG. 7.

Regarding to FIG. 1–17, there will be explained a first embodiment of a valve gear mechanism having a timing mechanism for providing a variable valve timing for an internal combustion engine in the following. A rotating body 10 formed as a cam is rotatably supported on a shaft 1 formed as a cam shaft, such shaft 1 preferrably being driven by the crank shaft of the internal combustion engine (not shown) at half the speed of rotation of the crank shaft when the internal combustion engine is in operation. In axial direction adjacent to cam 10 is provided an inner eccentric element 91 being rotatably fixed to a cylinder head 93 indicated only by a minor cut portion. An outer eccentric element 90 is rotatably supported on an outer surface of inner eccentric element 91 being eccentric element to the axis of rotation D. Inner eccentric element 91 can be rotated via an inner eccentric gear ring 91A while outer eccentric element 90 can be rotated via an outer eccentric gear ring 90A being coaxial to the inner eccentric element having an axis of rotation D, which outer eccentric gear ring 90A engages with its projection 90B a groove 90C of the outer eccentric element.

Between cam 10 and the eccentric element assembly there is located an intermediate member 20 which is rotatably supported on an eccentric outer surface of outer eccentric element 90. Depending on the position of outer eccentric element 90 and inner eccentric element 91 this intermediate member 20 takes a coaxial position with respect to axis of rotation D or a position, in which its axis of rotation is shifted with respect to the axis of rotation D of cam shaft 1.

The intermediate member 20 is operatively connected with cam shaft 1 and cam 10 so that a rotation of cam shaft 1 is transmitted to cam 10 via intermediate member 20. If, depending on the position of outer eccentric element 90 and inner eccentric element 91, the rotation of intermediate member 20 is effected concentrically with the rotation of cam shaft 1, cam 10 rotates in synchronism with cam shaft 1. If by respective displacement of outer eccentric element 90 and/or inner eccentric element 91 the intermediate member 20 is shifted from its concentric position in a radial direction with respect to cam shaft 1, there occurs a cyclic increase and decrease, respectively, of the speed of rotation of cam 10 as compared with the speed of rotation of cam shaft 1 at each rotation.

The operative connection between cam shaft 1 and intermediate member 20 is effected by a radial pin 40 which is inserted in a respective radial bore 4 of cam shaft 1. Cam shaft 1 has a longitudinal bore 2 and the radial bore 4 has a depth which is larger than the sum of the radius of the cam shaft and the radius of the longitudinal bore.

The radial pin 40 has a cylindrical portion 42 being completely inserted in cam shaft 1 and a substantially rectangular portion 43 protruding out of cam shaft 1. Between the cylindrical portion 42 and the rectangular portion 43 there is formed a step 41. Radial pin 40 is securely fixed in cam shaft 1 by selecting appropriate dimensions for the cylindrical portion 42 of radial pin 40 and radial bore 4 and by a respective stop at the closed end of radial bore 4. Inner eccentric element 91 partially overlaps the radial bore 4 as an additional positive safety so that due to step 41 there is an additional safety against radial pin 40 creeping out of bore 4.

Figure 12:
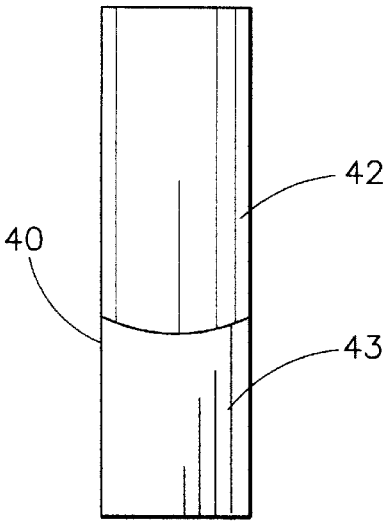
FIG. 12 is a first side view of an embodiment of a radial pin.
Figure 13:
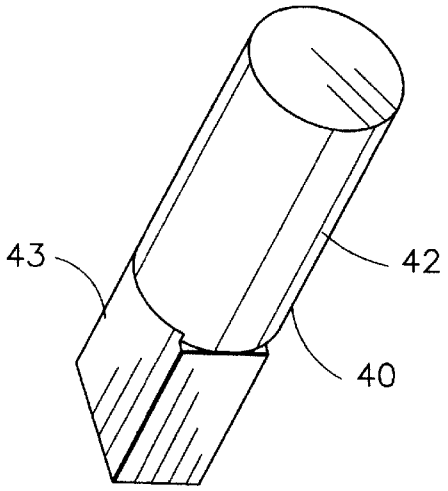
FIG. 13 is a perspective view of the radial pin shown in FIG. 12.
Figure 14:
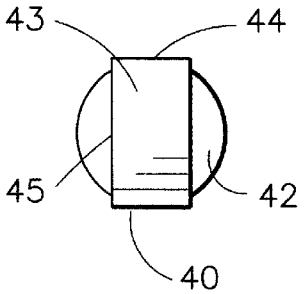
FIG. 14 is a top plan view of the radial pin shown in FIG. 12.
Figure 15:
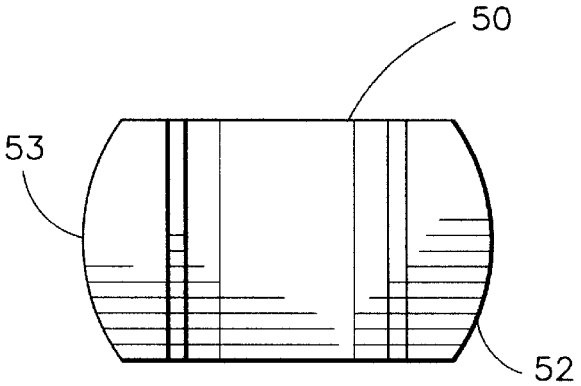
FIG. 15 is a first side view of an embodiment of the sliding block.
Figure 16:
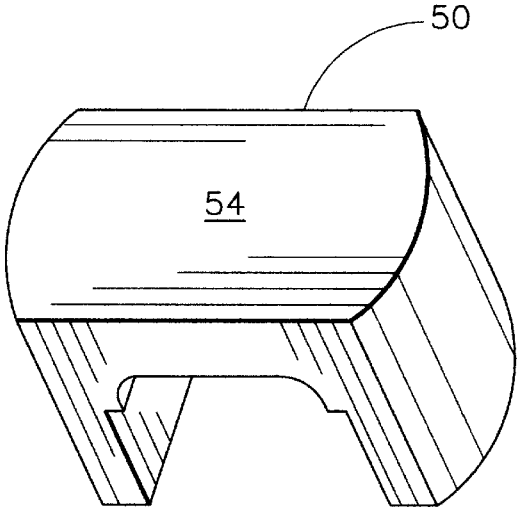
FIG. 16 is a perspective view of the sliding block shown in FIG. 15.
Figure 17:
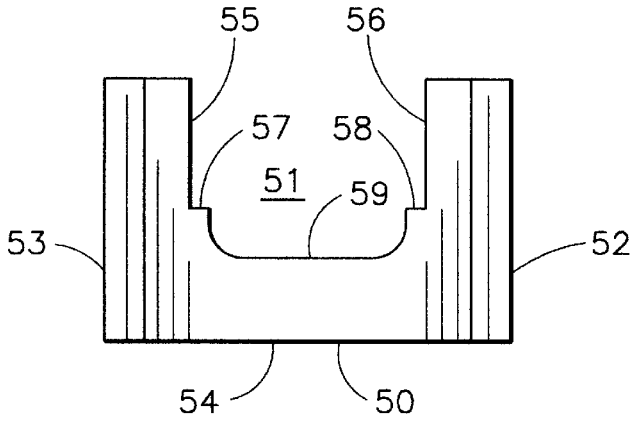
FIG. 17 is a top plan view of the sliding block shown in FIG. 15 in the direction of arrow X in FIG. 15.

In order to provide more advantageous friction conditions between the portion of the inner eccentric element 91 partially overlapping bore 4 and step 41 between the cylindrical portion 42 and the rectangular portion 43 of radial pin 40, step 41 is formed with a radius corresponding to the curvature of the surface of cam shaft 1 (see FIG. 12). This ensures a planar contact and the creation of a lubricating film.

The rectangular portion 43 is slidably surrounded by a recess 51 of a sliding block 50. The sliding block 50 has the form of a portion of a cylinder flattened at two sides wherein the both curved side surfaces 52, 53 are outer segments of a cylinder which are connected by a front surface 54. The recess 51 is open to the opposite side of front surface 54 and has two sliding surfaces 55, 56 for sliding contact with two opposing surfaces of the rectangular portion 43 of radial pin 40 and two shoulders 57, 58 for contacting a third surface of the rectangular portion 43 of radial pin 40.

A dimple 59 is formed between shoulders 57, 58 for facilitating the mounting of radial pin 40. Specifically, in case the diameter of the cylindrical portion 42 of radial pin 40 is smaller than at least the larger of both sides 44, 45 of the cross sectional area of its substantially rectangular portion 43, the radial pin 40 can be inserted into shaft 1 through the recess 51 being in alignment with the radial bore 4 due to that dimple 59.

The rectangular portion 43 of radial pin 40 and the recess 51 of sliding block 50 have respective corresponding dimensions enabling sliding block 50 to slide over rectangular portion 43.

The intermediate member 20 has a bearing seat 22 which is open to the side facing cam 10. The concave side walls 25, 26 adjacent such open side of bearing seat 22 are formed in correspondence with the radius of the side surfaces 52, 53 of sliding block 50 so that the sliding block 50 being insertable into the bearing seat 22 through the open side of bearing seat 22 can be pivoted with respect to the intermediate member 20. An end surface 27 of bearing seat 22 serves for contacting sliding block 50. A dimple 27A provided in the end surface 27 enables insertion of radial pin 40 in the course of assembly.

A groove 23 is formed on the side of the intermediate member 22 opposite to the bearing seat 22 which groove engages sliding block lug 71 being integrally formed with axial pin 70. Axial pin 70 is rotatably supported in a bore 13 in cam 10 having a closed end and being parallel to the axis of rotation D. A rotating body oil bore 19 provided in cam 10 is at least temporarily in alignment with a shaft oil bore 3 of cam shaft 1 and ends with its opposite end in bore 13 in a region between the end of axial pin 70 opposite to sliding block lug 71 and the closed end of bore 13. A corresponding groove (not shown) of cam 10 in the region of the bearing surface for cam shaft 1 can secure that the rotating body oil bore 19 is in connection with the shaft oil bore 3 during the entire range of rotation of cam 10 with respect to cam shaft 1. This ensures that an oil pressure prevailing in longitudinal bore 2 of cam shaft 1 is applied to the end surface of axial pin 70 and sliding block lug 71 is forced against end wall 24 of groove 23 of intermediate member 20 so that backlash between sliding block lug 71 and groove 23 is dampened during change of contact surfaces. The diameter of the cylindrical portion of axial pin 70 is preferably smaller than the width of sliding block lug 71 and groove 23, respectively. The length of the cylindrical portion of axial pin 70 is preferably larger than half the width of cam 10.

Intermediate member 20 includes a web 21 extending substantially in the circumferential direction on that end side having the open side of groove 23 and the open side of bearing seat 22, such web 21 being discontinuous because of groove 23 and the open side of bearing seat 22. Web 21 can be placed in groove 11 being formed on the side of cam 10 facing intermediate member 20 by radial insertion. Groove 11 extends substantially in circumference direction and is discontinuous due to an orifice 12 enabling the radial insertion of web 21. The depth of groove 11 and the size of web 21 are selected such that a pivoting moment of intermediate member 20 can be taken up and, at the same time, a radial displacement and a rotation of intermediate member 20 with respect to cam 10 is possible to a certain extent.

Groove 11 of cam 10 is defined on its side facing intermediate member 20 by a web 17 extending substantially in circumferential direction, such web 17 also being discontinuous due to orifice 12. In order to make the contact surface for taking up the pivoting moment bigger, web 17 deviates from the circumferential direction in a central region 18 along line C—C in FIG. 3. In this region web 17 is increased in height with respect to its bottom, for instance by forming the upper edges of web 17 such that on both sides of the bore for the cam shaft 1 such edges extend parallel to each other.

In accordance therewith, the bottom of groove 28 formed by web 21 on intermediate member 20 is lowered in a central region 29 with respect to the upper edge of web 21, for instance by forming the bottom portions of groove 28 in central region 29 such that they have a different radius of curvature.

Taken into account the fact that in internal combustion engines having a plurality of cylinders a plurality of timing mechanisms as just described are mounted of a continuous cam shaft 1, the assembly of such mechanism is conducted as follows.

The cylindrical portion of axial pin 70 is inserted in bore 13 of cam 10. Sliding block 50 is placed in bearing seat 22 from the open side thereof. Intermediate member 20 is inserted with its web 21 in groove 11 from the side of cam 10 opposite to the bore 13 and the cam peak, respectively. This makes sliding block lug 71 enter groove 23. In this position, intermediate member 20 and cam 10 are fixed to each other in axial direction. The assembly of the intermediate member and the cam produced that way is shifted onto the cam shaft and the recess of sliding block 50 is aligned with the radial bore 4 in cam shaft 1. Radial pin 40 is inserted in radial bore 4 through recess 51. The preassembled eccentric element unit including outer eccentric element 90, inner eccentric element 91 and eccentric gear rings 90A, 91A is shifted onto the cam shaft and outer eccentric element 90 is inserted in the bearing seat of intermediate member 20. In this end position, inner eccentric element 91 partially overlaps radial bore 4 and prevents radial pin 40 against creeping out.

Figure 18:
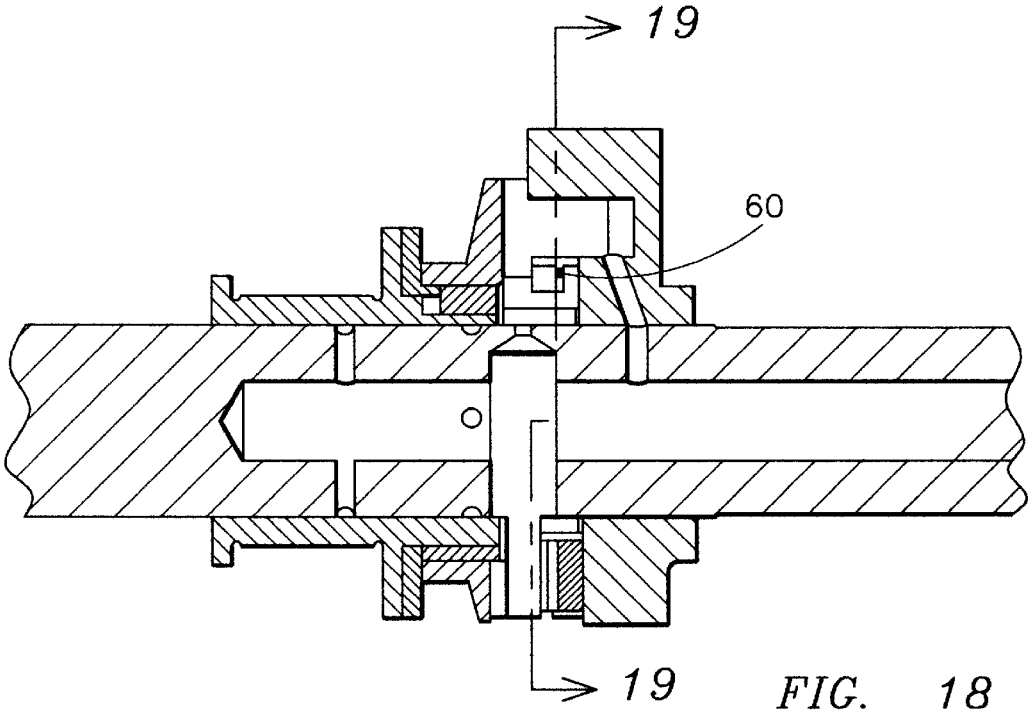
FIG. 18 is an axial section of a second embodiment of an assembly according to the present invention.
Figure 19:
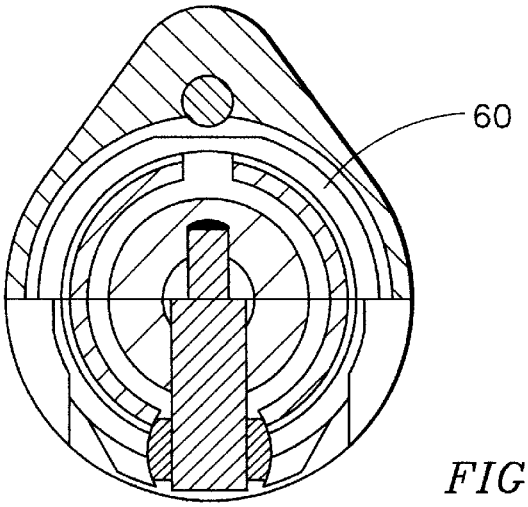
FIG. 19 is a radial section taken along line G—G in FIG. 18.
Figure 20:
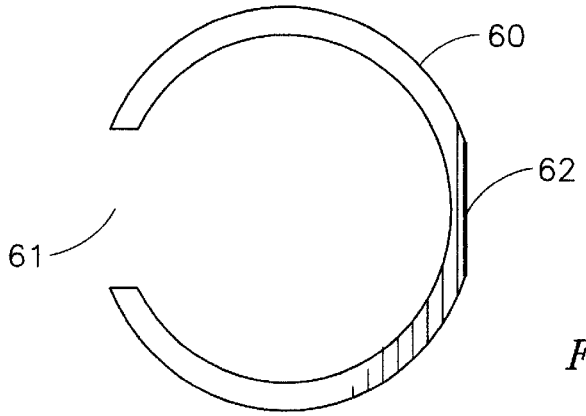
FIG. 20 is a depiction of an intermediate disk.

Referring to FIGS. 18 to 20, a second embodiment shall be explained which distinguishes from the first embodiment explained above only in that groove 11 of cam 10 receives in addition to web 21 of intermediate member 20 an intermediate disk 60 serving to make the contact surface for the intermediate member 20 bigger, particularly in the region of the orifice 12 at cam 10. Intermediate disk 60 is substantially annular and has a flattened portion 62 pointing to the cam peak which provides clearance for the axial pin 70 and serves as a means preventing rotation. On the side opposite to the flattened portion 62 there is provided a gap 61 providing clearance for the sliding block 50.

Figure 21:
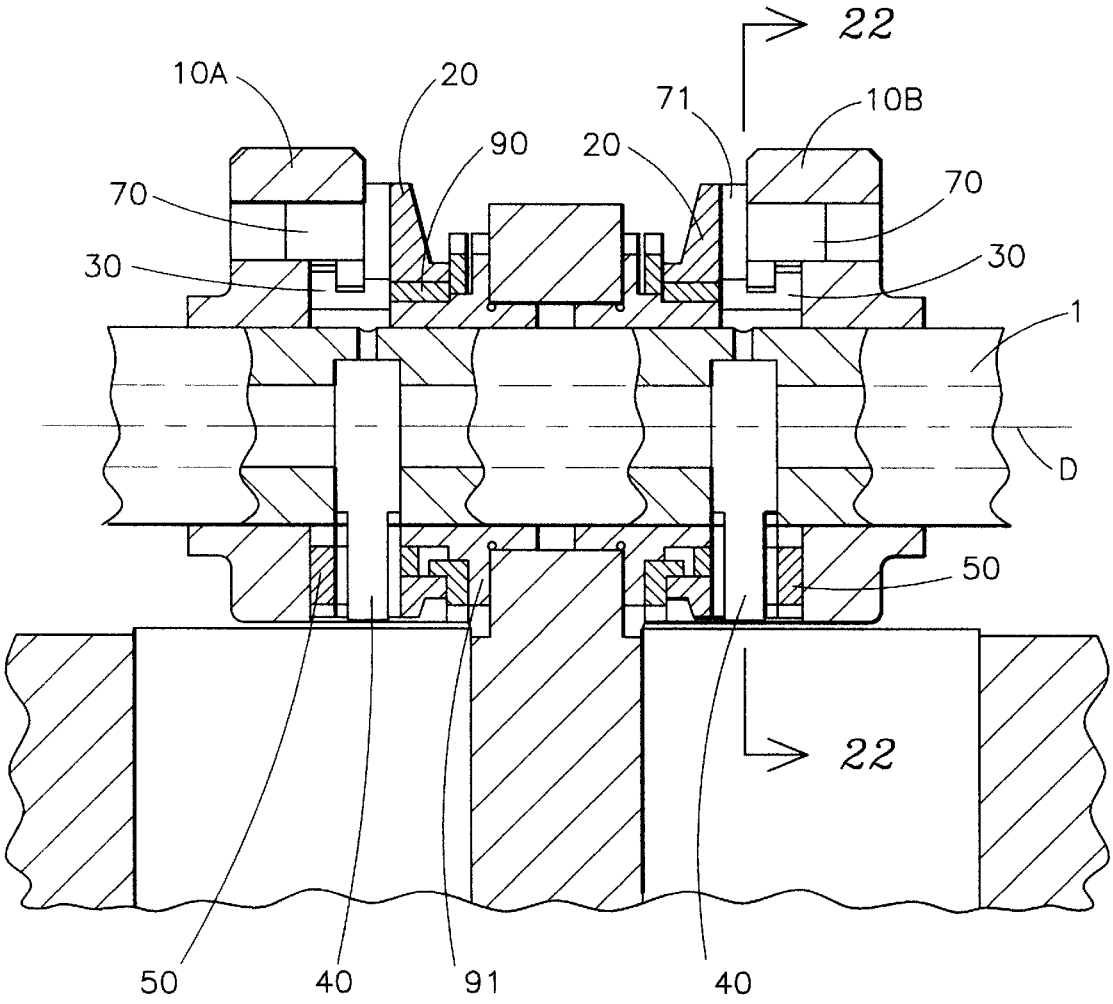
FIG. 21 is a radial section of a third embodiment of the assembly according to the present invention.
Figure 22:
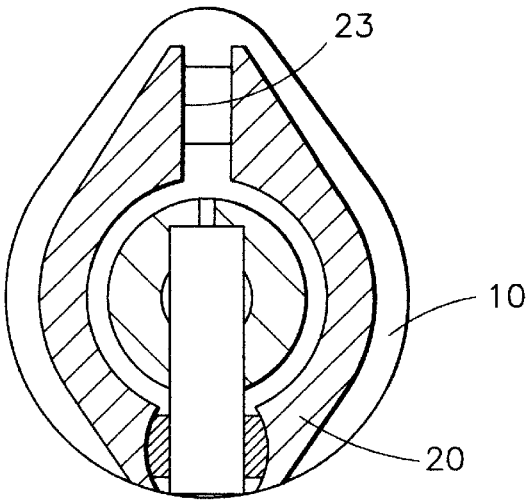
FIG. 22 is a radial section taken along line L—L in FIG. 21.
Figure 23:
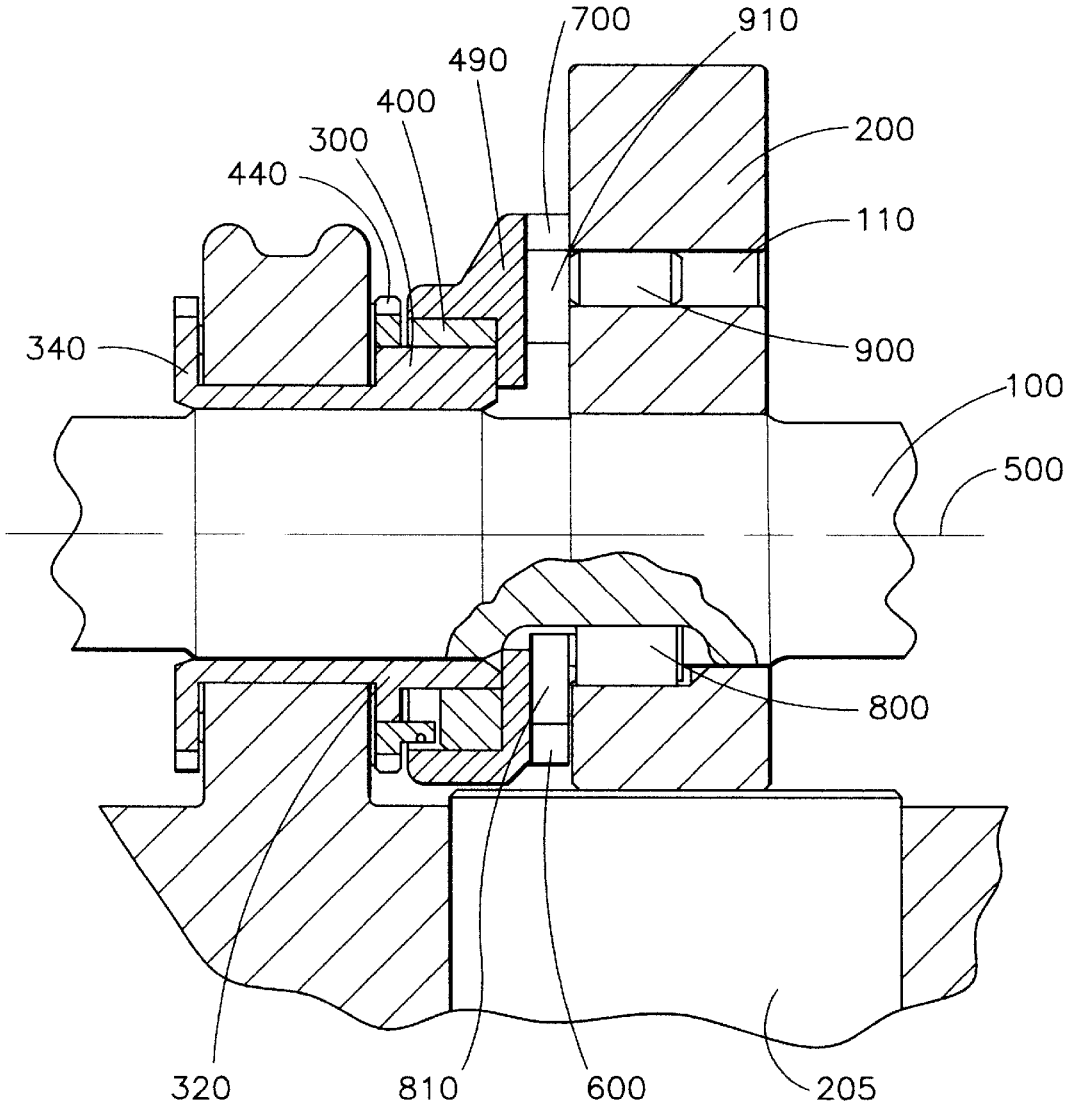
FIG. 23 is an axial section of a timing mechanism according to a prior art not pre-disclosed.

FIG. 21 shows a third embodiment having a common inner eccentric element 91 for two cams 10A, 10B. In this embodiment there is provided a timing unit on both sides of the cam shaft bearing so that subsequent insertion of the eccentric elements is not possible. Therefore, both eccentric elements are provided with local openings (not shown) so that the radial pins can be inserted in respective radial bores 4 of cam shaft 1 through recesses 41 in the respective sliding blocks 50 when the preassembly unit comprising cams 10A, 10B, both intermediate members 20 and the eccentric elements is completed.

We claim:

1. A valve gear mechanism for an internal combustion engine comprising:

a. a shaft having an axis of rotation and serving to transmit the necessary rotary motion to the valve gear mechanism;

b. a rotating body mounted in such a way that it is rotatable relative to said shaft; and c. an intermediate member surrounding said shaft and being located adjacent to the rotatable rotating body in an axial direction and having a drive connection to said shaft via a first sliding guide and a first transmission element and to said rotating body via a second sliding guide and a second transmission element, wherein at least one transmission element comprises a radial pin disposed substantially perpendicular to the axis of rotation of said shaft, said radial pin being moveable with respect to at least one of said shaft and the intermeiate member.

2. The valve gear mechanism as claimed in claim 1, characterized in that said first transmission element is said radial pin and is slidably received in a recess of a sliding block being pivotably supported in a bearing seat of said intermediate member.

3. The valve gear mechanism as claimed in claim 1, characterized in that said radial pin has a cylindrical portion and a substantially rectangular portion, said cylindrical portion being inserted in a radial bore of said shaft and said substantially rectangular portion being in sliding engagement with said recess of said sliding block.

4. The valve gear mechanism as claimed in claim 3, characterized in that a step is provided between said cylindrical portion and said substantially rectangular portion of said radial pin , said step forming together with an element to be shifted onto said shaft a positive locking means against said radial pin creeping out of said radial bore.

5. The valve gear mechanism as claimed in claim 3, characterized in that the diameter of said cylindrical portion is smaller than the larger of both sides of the cross sectional area of said substantially rectangular portion.

6. The valve gear mechanism as claimed in claim 2, characterized in that said sliding block has the outer contour of a cylinder segment flattened on two sides, wherein both curved side surfaces are outer segments of a cylinder which are connected by a front surface.

7. The valve gear mechanism as claimed in claim 6, characterized in that said recess is open at the side of the sliding block opposite to said front surface.

8. The valve gear mechanism as claimed in claim 7, characterized in that said sliding block has two sliding surfaces for sliding contact with two opposing surfaces of said rectangular portion of said radial pin and two shoulders for contacting a third surface of said rectangular portion of said radial pin.

9. The valve gear mechanism as claimed in claim 8, characterized in that a dimple is formed between said shoulders in order to facilitate mounting of said radial pin.

10. The valve gear mechanism as claimed in claim 6, characterized in that said bearing seat is open at that side of said intermediate member facing said rotating body and includes two concave side walls having radii of curvature corresponding to those of said side surfaces of said sliding block and an end surface for contacting said front surface of said radial pin.

11. The valve gear mechanism as claimed in claim 1, characterized in that the axial fixing of said rotating body and said intermediate member on said shaft is effected by said radial pin.

12. The valve gear mechanism as claimed in claim 1, characterized in that said second transmission element comprises an axial pin parallel to said axis of rotation and rotatably supported in a bore of said rotating body.

13. The valve gear mechanism as claimed in claim 12, characterized in that one end of said axial pin is provided with a sliding block lug having two parallel side surfaces which engages a groove of said intermediate member, said side surfaces extending in the direction of said groove on at least one side of said axial pin beyond the circumference thereof so that said axial pin together with said sliding block lug has at least one of an L-form and a T-form.

14. The valve gear mechanism as claimed in claim 12, characterized in that said bore in said rotating body is closed at the end thereof opposite to said intermediate member, said shaft has a longitudinal bore and at least one shaft oil bore extending from said longitudinal bore to the outer surface of said shaft and said rotating body has a rotating body oil bore through which oil from said longitudinal bore via said shaft oil bore can reach said bore in a region between the closed end thereof and said axial pin, whereby said axial pin is forced into close contact to the end wall of said groove.

15. The valve gear mechanism as claimed in claim 1, characterized in that said intermediate member is rotatably supported on an outer eccentric element which is rotatably supported on an eccentric circumferential surface of an inner eccentric element rotatably supported on said shaft.

16. The valve gear mechanism as claimed in claim 15, characterized in that two adjacent rotating bodies are provided on a common inner eccentric element.

17. The valve gear mechanism as claimed in claim 1, characterized in that between said rotating body and said intermediate member there is provided a third sliding guide constituting a support between said rotating body and said intermediate member and, at the same time, allowing a relative movement between said rotating body and said intermediate member in a direction perpendicular to said axis of rotation.

18. The valve gear mechanism as claimed in claim 1, characterized in that said shaft is a cam shaft and said rotating body is a cam for operating a gas exchange valve.

* * * * *